US010185242B2

(12) United States Patent
Nagatoshi

(10) Patent No.: US 10,185,242 B2
(45) Date of Patent: Jan. 22, 2019

(54) OPTICAL SCANNING APPARATUS AND IMAGE FORMING APPARATUS

(71) Applicant: CANON KABUSHIKI KAISHA, Tokyo (JP)

(72) Inventor: Jun Nagatoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/916,129

(22) Filed: Mar. 8, 2018

(65) Prior Publication Data

US 2018/0259876 A1 Sep. 13, 2018

(30) Foreign Application Priority Data

Mar. 13, 2017 (JP) ..... 2017-047260
Dec. 26, 2017 (JP) ..... 2017-248612

(51) Int. Cl.
*G03G 15/00* (2006.01)
*G03G 15/04* (2006.01)

(52) U.S. Cl.
CPC ... *G03G 15/04072* (2013.01); *G03G 15/0409* (2013.01); *G03G 15/50* (2013.01); *G03G 2215/0404* (2013.01)

(58) Field of Classification Search
USPC ..... 399/1, 4, 118, 177, 220, 221; 359/205.1, 359/207.1
See application file for complete search history.

(56) References Cited

U.S. PATENT DOCUMENTS 5,805,323 A * 9/1998 Ichikawa ..... G02B 27/0031 359/205.1
6,512,623 B1 * 1/2003 Ishihara ..... G02B 26/125 359/207.1
9,581,929 B2 * 2/2017 Nagatoshi ..... G03G 21/1666

FOREIGN PATENT DOCUMENTS

JP 2016-109780 A 6/2016

* cited by examiner

*Primary Examiner* — Hoan Tran
(74) *Attorney, Agent, or Firm* — Canon U.S.A. Inc., IP Division

(57) ABSTRACT

There is a demand for an inexpensive optical scanning apparatus. An optical scanning apparatus includes a light source configured to emit a laser light flux, a deflection unit configured to deflect the laser light flux emitted from the light source, and a light reception member configured in such a manner that the laser light flux reflected by the deflection unit is incident thereon. The light source emits the laser light flux tilted by a predetermined angle with respect to a horizontal direction toward the deflection unit. The light reception member is disposed above or below the light source, and the laser light flux reflected by the deflection unit and tilted by the predetermined angle with respect to the horizontal direction is incident on the light reception member.

20 Claims, 10 Drawing Sheets

OPTICAL SCANNING APPARATUS AND IMAGE FORMING APPARATUS

BACKGROUND OF THE INVENTION

Field of the Invention

The present invention relates to an optical scanning apparatus that scans a scanning target surface with a laser light flux emitted from a light source and deflected by a deflection unit, and an image forming apparatus including this optical scanning apparatus, such as a laser beam printer (hereinafter referred to as an LBP), a digital copying machine, and a digital fax machine (FAX).

Description of the Related Art

An optical scanning apparatus for use with an image forming apparatus based on the electrophotographic method optically writes an image onto a photosensitive drum or the like with use of a laser beam as discussed in Japanese Patent Application Laid-Open No. 2016-109780. The optical scanning apparatus discussed in Japanese Patent Application Laid-Open No. 2016-109780 writes the image onto the photosensitive drum in the following manner. The optical scanning apparatus emits a laser light flux from a semiconductor laser unit. The emitted laser light flux passes through a lens and is imaged as a linear image on a reflection surface of a polygon mirror. Then, the laser light flux is deflected due to a rotation of the polygon mirror, and is imaged and caused to scan on a photosensitive surface (the scanning target surface) that is a surface of the photosensitive drum via an fθ lens, by which an electrostatic latent image is formed on the scanning target surface. When the polygon mirror is located in a predetermined rotational phase, the reflected laser light flux is incident on a beam detector (BD) sensor as a signal output unit that outputs a BD signal.

However, according to the technique discussed in Japanese Patent Application Laid-Open No. 2016-109780, the semiconductor laser unit, the BD sensor, and the fθ lens are arranged on a same plane, and the laser light flux is deflected and caused to scan on the same plane. Therefore, to dispose the BD sensor, an angle of the laser light flux from the semiconductor laser unit with respect to a center of the photosensitive surface in a scanning direction (a laser incident angle) is undesirably increased to approximately a right angle.

The increase in the laser incident angle leads to an increase in a width of the linear image on the reflection surface of the polygon mirror, raising a necessity of increasing a width of the reflection surface of the polygon mirror in a longitudinal direction of the linear image (hereinafter referred to as a width in a main scanning direction). The increase in the width of the reflection surface of the polygon mirror in the main scanning direction may result in increase in processing cost and material cost of the polygon mirror.

SUMMARY OF THE INVENTION

Therefore, according to an aspect of the present invention, a representative configuration of an optical scanning apparatus includes a light source configured to emit a laser light flux, a deflection unit configured to deflect the laser light flux emitted from the light source, and a light reception member configured in such a manner that the laser light flux reflected by the deflection unit is incident thereon. The light source emits the laser light flux tilted by a predetermined angle with respect to a horizontal direction toward the deflection unit. The light reception member is disposed above or below the light source, and the laser light flux reflected by the deflection unit and tilted by the predetermined angle with respect to the horizontal direction is incident on the light reception member.

Further features of the present invention will become apparent from the following description of exemplary embodiments with reference to the attached drawings.

DESCRIPTION OF THE EMBODIMENTS

In the following description, an exemplary embodiment of the present invention will be described in detail with reference to the drawings by way of example. However, dimensions, materials, shapes, a relative layout, and the like of components that will be described in the following exemplary embodiment shall be changed as appropriate according to a configuration of an apparatus to which the present invention is applied and various kinds of conditions. Therefore, they are not intended to limit the scope of the present invention only thereto unless otherwise specifically indicated.

Figure 10:
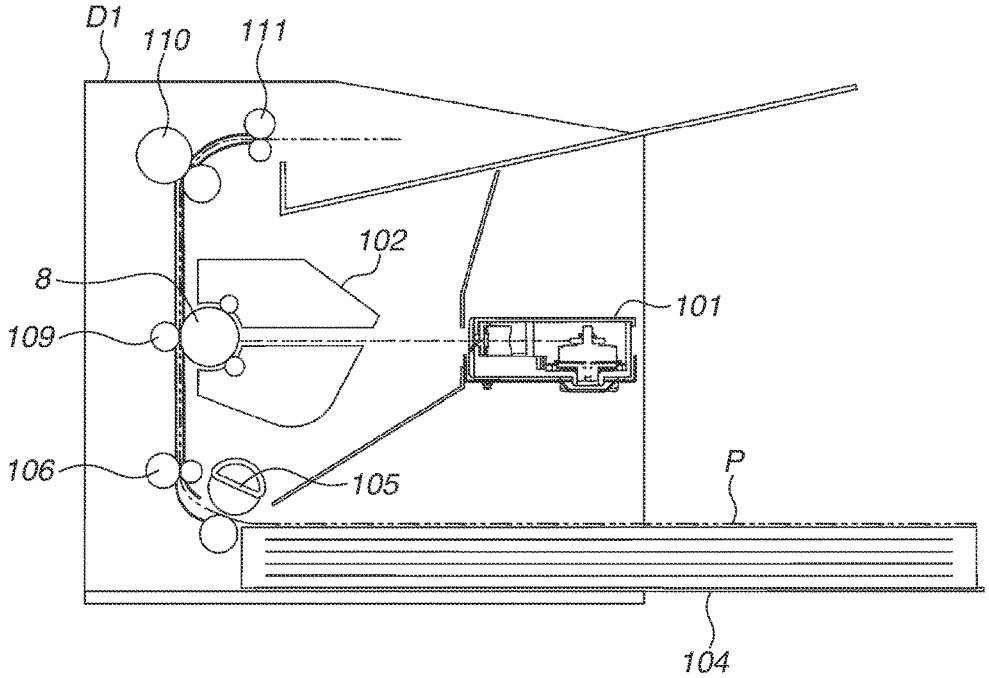
FIG. 10 is a cross-sectional view of an image forming apparatus including the optical scanning apparatus.

In the following description, a first exemplary embodiment will be described. First, an image forming apparatus D1 will be described with reference to FIG. 10. FIG. 10 is a schematic cross-sectional view of the image forming apparatus D1 including an optical scanning apparatus 101 according to the present exemplary embodiment.

The image forming apparatus D1 includes the optical scanning apparatus 101, and scans a photosensitive drum as an image bearing member by the optical scanning apparatus 101 to form an image on a recording material P such as recording paper based on an image drawn by this scanning. As illustrated in FIG. 10, the image forming apparatus D1 emits a laser light flux based on image information from the optical scanning apparatus 101, and irradiates a surface of a photosensitive drum 8 as the image bearing member built in a process cartridge 102 therewith. The surface of the photosensitive drum 8 is irradiated with and exposed to the light flux, by which a latent image is formed on the photosensitive drum 8. The latent image formed on the photosensitive drum 8 is visualized as a toner image with use of toner. The process cartridge 102 is a unit integrally including the photosensitive drum 8, and a charging unit, a development unit, and the like as process units acting on the photosensitive drum 8, and attachable to and detachable from the image forming apparatus D1. On the other hand, the recording material P such as a sheet contained in a sheet feeding cassette 104 is fed while being separated one by one by a sheet feeding roller 105, and is conveyed further downstream by a conveyance roller 106. The toner image formed on the photosensitive drum 8 is transferred onto the recording material P by a transfer roller 109. The recording material P with the toner image formed thereon is conveyed further downstream, and the toner image is heated and fixed onto the recording material P by a fixing unit 110 including a heater therein. After that, the recording material P is discharged out of the apparatus by a discharge roller 111.

Figure 1:
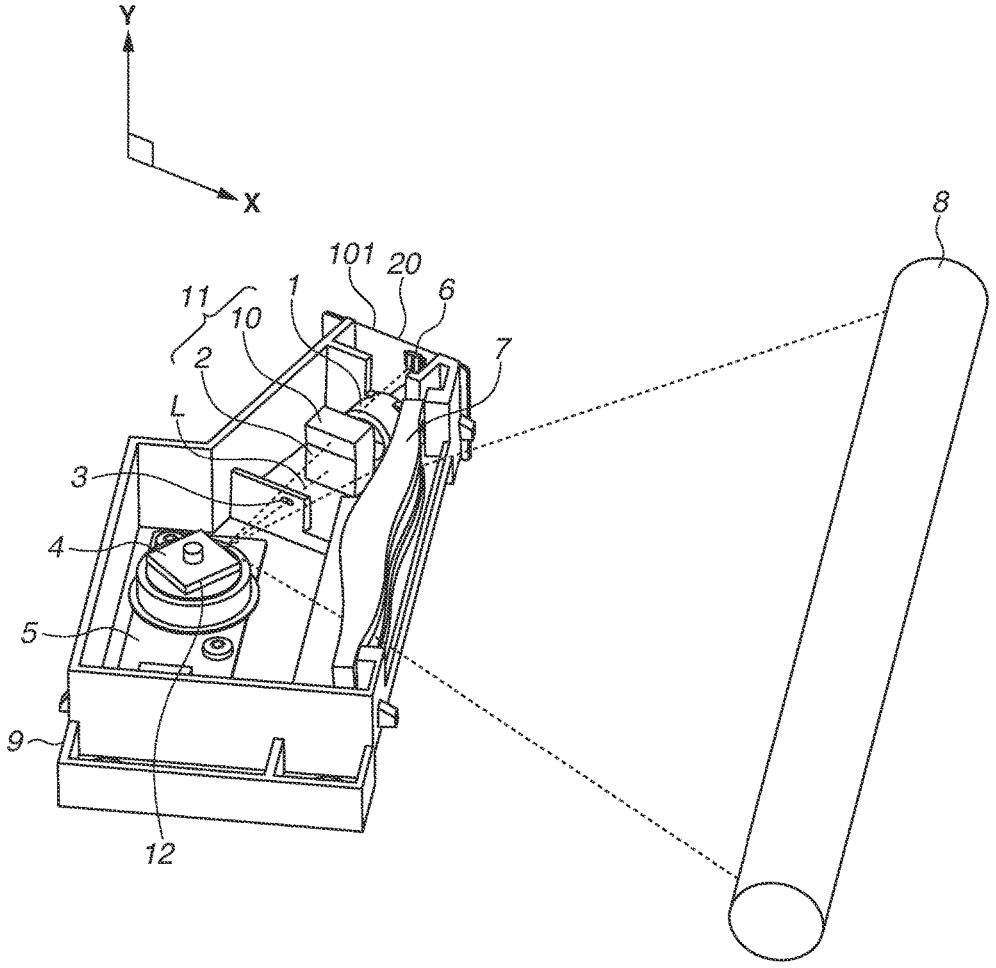
FIG. 1 is a perspective view of an optical scanning apparatus.

Next, the optical scanning apparatus 101 according to the present exemplary embodiment will be described with reference to FIG. 1. FIG. 1 is a perspective view of the optical scanning apparatus 101 and the photosensitive drum 8 according to the present exemplary embodiment.

(Optical Scanning Apparatus)

As illustrated in FIG. 1, the optical scanning apparatus 101 includes the following optical members. The optical scanning apparatus 101 includes a semiconductor laser unit 1 and a compound anamorphic collimator lens 11. The semiconductor laser unit 1 is a light source that emits a laser light flux L. The compound anamorphic collimator lens 11 is a lens integrally including an anamorphic collimator lens 2 having both a function as a collimator lens and a function as a cylindrical lens, and a writing start position signal detection lens (a BD lens) 10. Further, the optical scanning apparatus 101 includes an aperture diaphragm 3, a rotational polygonal mirror (a polygon mirror) 4, a reflection surface 12 of the polygon mirror 4, a light deflector (a scanning motor) 5, a writing start position synchronization signal detection unit (a BD sensor) 6, an fθ lens (a scanning lens) 7, and a substrate 20. The above-described semiconductor laser unit 1 and the above-described BD sensor 6 are mounted on the substrate 20, and the substrate 20 includes a driving circuit (not illustrated) that drives the above-described semiconductor laser unit 1. The optical scanning apparatus 101 contains the above-described optical members in an optical box 9.

The semiconductor laser unit 1, the compound anamorphic collimator lens 11, the scanning motor 5, and the scanning lens 7, which is an imaging unit, are fixed in the optical box 9 by press-fitting, adhesion, fastening with a screw, or the like.

The semiconductor laser unit 1 emits the laser light flux L, and forms a linear image on the reflection surface 12 of the polygon mirror 4 by the anamorphic collimator lens 2. The polygon mirror (a deflection unit) 4 is rotationally driven by the scanning motor 5, and deflects the laser light flux L emitted from the semiconductor laser unit 1. Then, the laser light flux L deflected by the polygon mirror 4 is imaged and scans on a scanning target surface (the surface of the photosensitive drum 8) by passing through the scanning lens 7.

In the present disclosure, a scanning direction in which the laser light flux L deflected by the polygon mirror 4 is caused to scan the scanning target surface (the surface of the photosensitive drum 8) is defined to be a main scanning direction X, and a direction perpendicular to this scanning direction is defined to be a sub scanning direction Y.

Figure 2A:
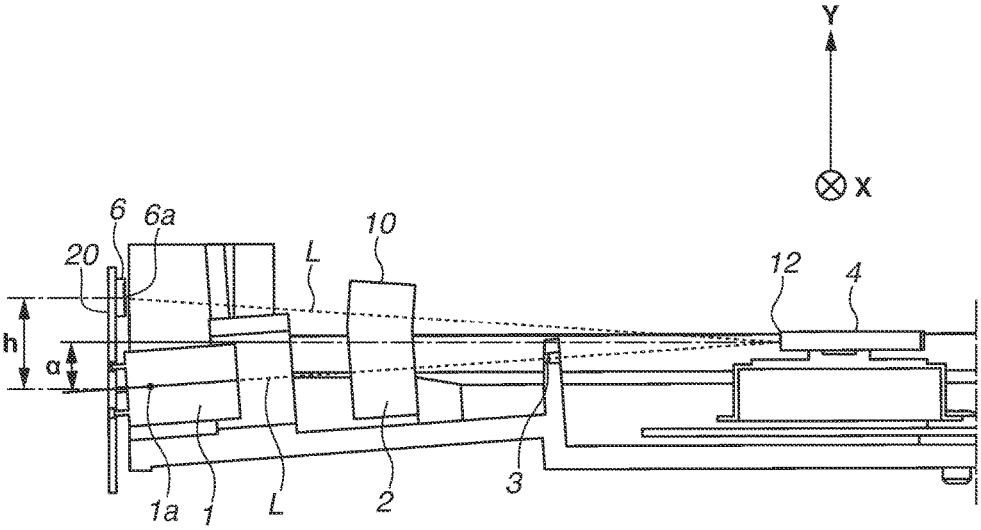
FIGS. 2A and 2B are each a partial cross-sectional view of the optical scanning apparatus.
Figure 2B:
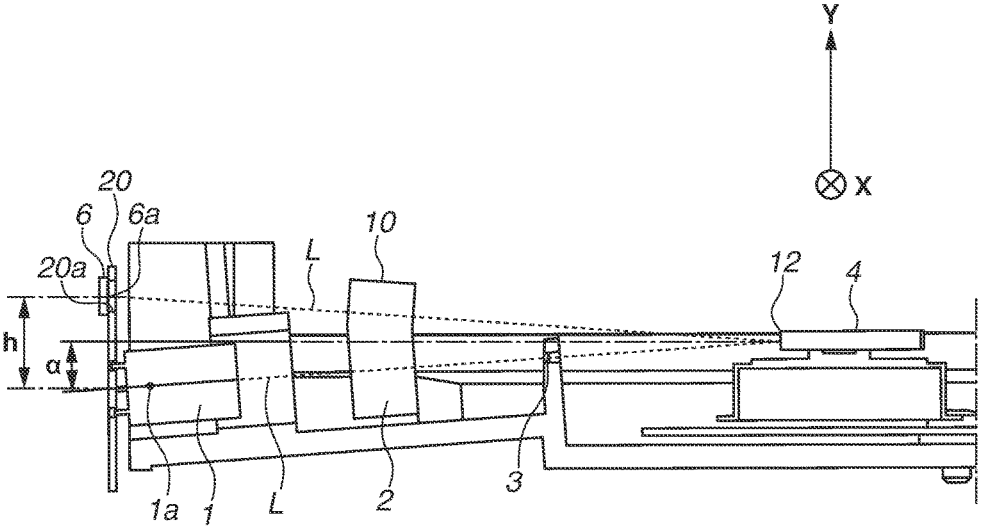

FIGS. 2A and 2B are each a partial cross-sectional view of the optical scanning apparatus 101 with the semiconductor laser unit 1, the anamorphic collimator lens 2, the BD lens 10, and the polygon mirror 4 taken along a plane perpendicular to the laser light flux emitted from the semiconductor laser unit 1.

Figure 9:
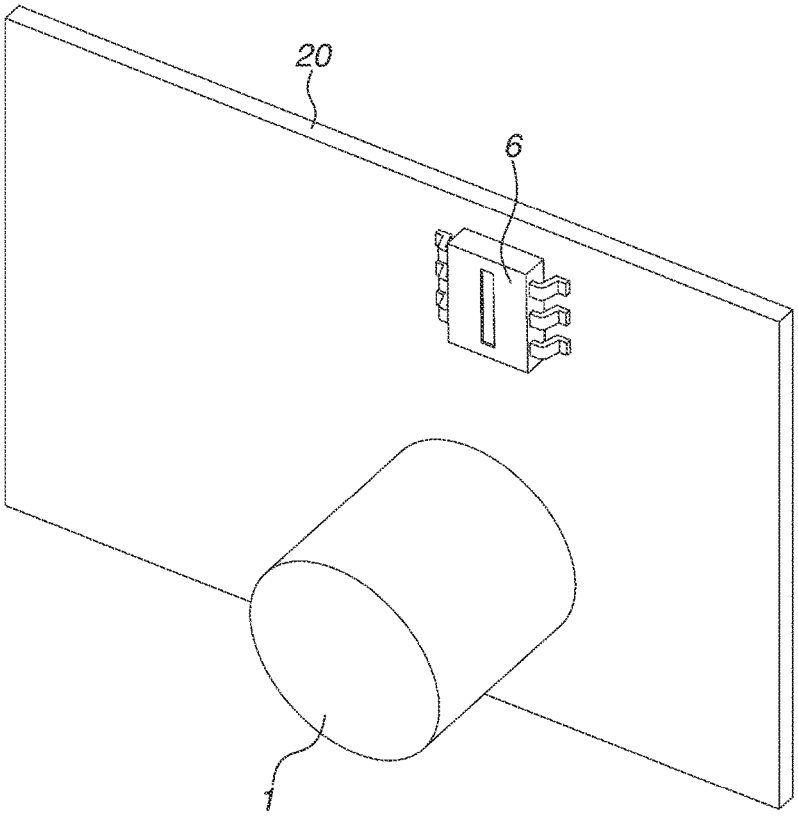
FIG. 9 is a perspective view illustrating a substrate with the semiconductor laser unit and a beam detector (BD) sensor mounted thereon.

The semiconductor laser unit 1 and the BD sensor 6 are arranged on a same line in the direction (the sub scanning direction Y) perpendicular to the scanning direction (the main scanning direction X) as illustrated in FIGS. 1 and 2A. Further, the semiconductor laser unit 1 and the BD sensor 6 are mounted on a same substrate. In the present example, the BD sensor 6 is mounted on the substrate 20 where the semiconductor laser unit 1 is mounted as illustrated in FIG. 9. Further, although the semiconductor laser unit 1 and the BD sensor 6 are arranged on the same line in the direction (the sub scanning direction Y) perpendicular to the scanning direction (the main scanning direction X), the layout thereof is not limited thereto. The semiconductor laser unit 1 and the BD sensor 6 can satisfy a layout condition just by being arranged on a substantially same line in the direction (the sub scanning direction Y) perpendicular to the scanning direction (the main scanning direction X). More specifically, because an intended result can be acquired just by allowing the reflected laser light flux L to pass through the BD lens 10, the semiconductor laser unit 1 and the BD sensor 6 may be disposed out of alignment with each other as long as this misalignment falls within a range of ±10 mm in the scanning direction (the main scanning direction X).

Further, in the optical scanning apparatus 101, the semiconductor laser unit 1 and the BD sensor 6 are disposed respectively on one side and the other side of the polygon mirror 4 in the direction (the sub scanning direction Y) perpendicular to the scanning direction (the main scanning direction X) deflected by the above-described polygon mirror 4.

More specifically, as illustrated in FIG. 2A, the semiconductor laser unit 1 emits the laser light flux L tilted upward by a predetermined angle α degrees with respect to a horizontal direction toward the anamorphic collimator lens 2. In FIG. 2A, the laser light flux L is emitted from an emission point 1*a* of the semiconductor laser unit 1. The laser light flux L is imaged as the linear image on the reflection surface 12 of the polygon mirror 4 by the anamorphic collimator lens 2. The reflection surface 12 of the polygon mirror 4 extends substantially vertically, and the reflected light flux L also travels straight ahead while being tilted upward by the predetermined angle α degrees with respect to the horizontal direction. This predetermined angle α can be set within a range of 2 to 10 degrees. In the present example, the above-described predetermined angle α is set to 4 degrees. The reflected laser light flux L passes through the BD lens 10 molded integrally with the anamorphic collimator lens 2, and is incident on the BD sensor 6. In FIG. 2A, the laser light flux L is incident on an incident point 6*a* of the BD sensor 6. At this time, the BD sensor (a light reception member) 6 outputs a signal based on receiving the laser light flux L, and determines a timing of starting writing the image to be optically emitted from the semiconductor laser unit 1 based on the output signal.

The laser light flux L tilted upward is emitted from the semiconductor laser unit 1 toward the polygon mirror 4, and the BD sensor 6 is disposed above the semiconductor laser unit 1 in a direction along a rotational shaft of the polygon mirror 4 (the sub scanning direction Y). More specifically, the BD sensor 6 is disposed in such a manner that the above-described incident point 6*a* is located at a higher position than the emission point 1*a* of the semiconductor laser unit 1. This layout allows the semiconductor laser unit 1 and the scanning lens 7 to be located close to each other in the scanning direction as illustrated in FIG. 1. As a result, a laser incident angle can be reduced.

Further, a distance h between the semiconductor laser unit 1 and the BD sensor 6 mounted on the same substrate 20 can be set within a range of 6 mm to 20 mm in the direction along the rotational shaft of the polygon mirror 4 (the sub scanning direction Y) as illustrated in FIG. 2A.

Further, the BD sensor 6 is disposed on the same surface as a surface (one surface) of the substrate 20 where the semiconductor laser unit 1 is mounted as illustrated in FIG. 2A, but the position of the BD sensor 6 is not limited thereto. As illustrated in FIG. 2B, the optical scanning apparatus 101 may be configured in such a manner that the BD sensor 6 is disposed on the other surface (a back surface) opposite from the one surface (a front surface) of the substrate 20 where the semiconductor laser unit 1 is mounted. In this case, a through-hole 20*a* is provided at a position of the above-described substrate 20 that corresponds to the above-described BD sensor 6 to allow the laser light flux L to be incident on the BD sensor 6.

FIGS. 3A to 3D illustrate the polygon mirror 4 as viewed from above a rotational shaft 14, and are each a schematic view illustrating a position of a linear image S on the reflection surface 12 of the polygon mirror 4. FIGS. 3A to 3D illustrate states in which the polygon mirror 4 is rotated in a clockwise direction as viewed from above, and reflection surfaces 12*a*, 12*b*, and 12*c* deflect the laser light flux L, in order starting from FIG. 3A. The linear image S is moved from the right to the left when the reflection surface 12*b* is viewed from above according to the rotation of the polygon mirror 4.

Figure 3A:
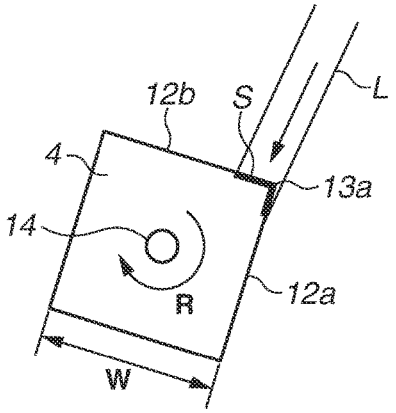
FIGS. 3A, 3B, 3C, and 3D are each a schematic view illustrating a position of a linear image on a reflection surface of a polygon mirror.

FIG. 3A illustrates a rotational phase of the polygon mirror 4 with the linear image S located across the reflection surfaces 12*a* and 12*b* among the four reflection surfaces 12 of the polygon mirror 4. A part of the laser light flux L hits a corner 13*a* of the polygon mirror 4, and stray light (unnecessary or unintended light) is generated. The stray light may cause an image defect, so that the semiconductor laser unit 1 should not emit the light with the laser light flux L expected to hit the corner 13*a*.

Figure 3B:
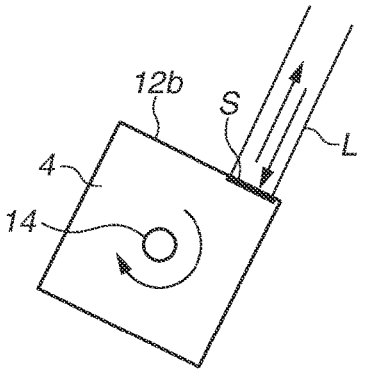

In FIG. 3B, the rotation of the polygon mirror 4 shifts from the state illustrated in FIG. 3A, and the reflection surface 12*b* faces the laser light flux L straight. The laser light flux L reflected in such a phase that the reflection surface 12*b* faces the laser light flux L straight is incident on the BD sensor 6 as illustrated in FIGS. 2A and 2B.

Figure 3C:
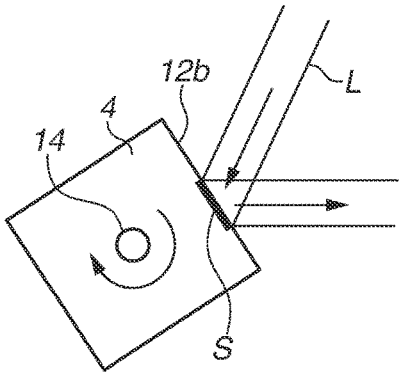

FIG. 3C illustrates a state in which the polygon mirror 4 is further rotated, and the polygon mirror 4 deflects the laser light flux L toward the not-illustrated scanning lens 7.

Figure 3D:
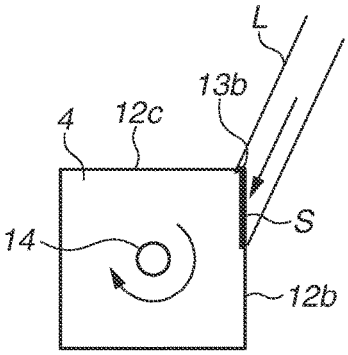

FIG. 3D illustrates a state in which the polygon mirror 4 is further rotated, and the linear image S is located across the reflection surfaces 12*b* and 12*c*. Similarly to FIG. 3A, a part of the laser light flux L hits a corner 13*b* and stray light is generated, so that the semiconductor laser unit 1 should not emit the light with the laser light flux L expected to hit the corner 13*b*.

Figure 4:
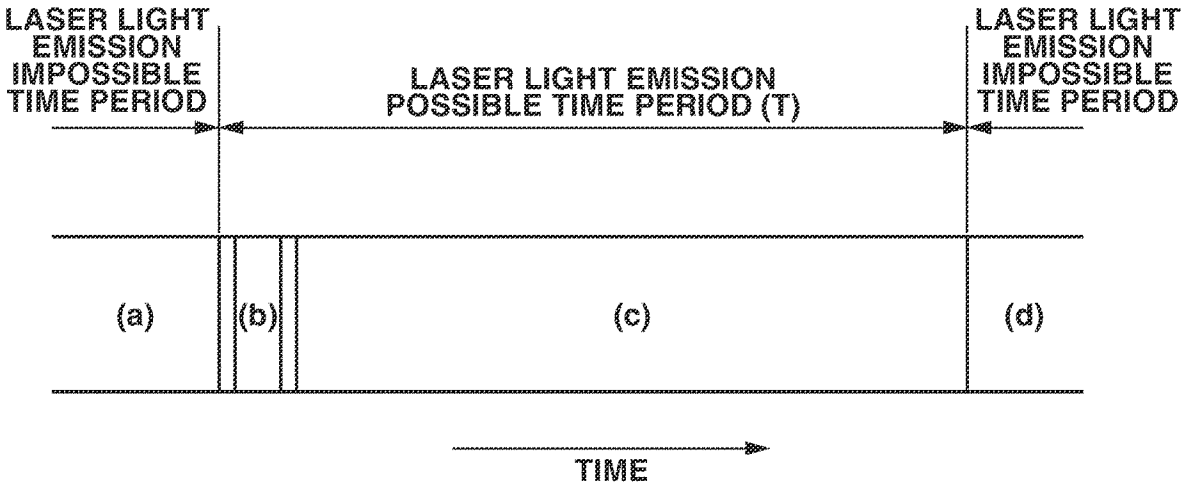
FIG. 4 illustrates light emission states of a semiconductor laser unit in chronological order.

FIG. 4 illustrates light emission states of the semiconductor laser unit 1 when the reflection surface 12*b*, which is one of the reflection surfaces of the polygon mirror 4, deflects the laser light flux L in chronological order.

Time periods (a) to (d) illustrated in FIG. 4 correspond to FIGS. 3A to 3D, respectively. As described with reference to FIGS. 3A to 3D, the laser light flux L should not be emitted during the time periods (a) and (d) since the laser light flux L would hit the corner 13*a* or 13*b* of the polygon mirror 4 and the stray light would be generated. Therefore, the laser light flux L can be emitted only during a time period other than the time periods (a) and (d).

In the present exemplary embodiment, the laser light flux L can be incident on the BD sensor 6 at the time period (b) when the reflection surface 12*b* faces the laser light flux L straight, and a time period other than the time period (b) can be used as an image formation time period (c) during which the laser light flux L is caused to scan on the photosensitive drum 8. Therefore, a large proportion of a laser light emission possible time period (T) can be used as the image formation time period (c). In other words, the present exemplary embodiment can shorten the laser light emission possible time period (T) while securing a certain time period as the image formation time period (c).

The laser light emission possible time period (T) is proportional to a width W of the reflection surface 12 of the polygon mirror 4 in the main scanning direction illustrated in FIG. 3A, and therefore the present exemplary embodiment shortens the laser light emission possible time period (T). As a result, the width W of the reflection surface 12 of the polygon mirror 4 in the main scanning direction can be reduced, which allows the polygon mirror 4 to have a small size.

Figure 5A:
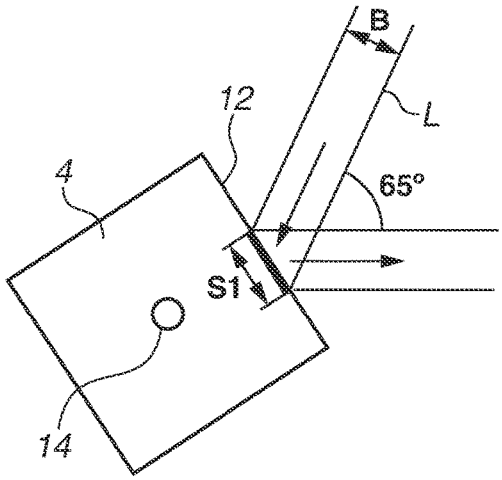
FIGS. 5A and 5B are each a schematic view illustrating a width of the linear image on the reflection surface of the polygon mirror.
Figure 5B:
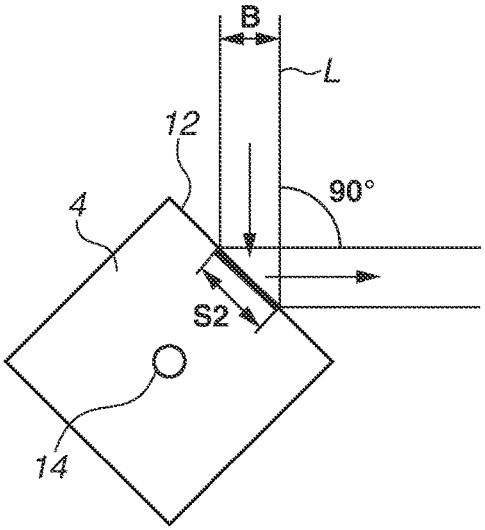

FIGS. 5A and 5B illustrate the polygon mirror 4 as viewed from above the rotational shaft 14, and are each a schematic view illustrating a width of the linear image S on the reflection surface 12 of the polygon mirror 4. The laser light flux L is emitted from the not-illustrated semiconductor laser unit 1 toward the polygon mirror 4 according to an illustrated arrow. Further, FIGS. 5A and 5B illustrate states in which the laser light flux L reflected by the polygon mirror 4 travels straight ahead toward a center of the not-illustrated photosensitive surface in the scanning direction. FIG. 5A illustrates the present exemplary embodiment, and an angle of the laser light flux L from the semiconductor laser unit 1 with respect to the center of the photosensitive surface in the scanning direction (the laser incident angle) is 65 degrees. FIG. 5B illustrates an example in which the laser incident angle is set to 90 degrees for comparison. The laser light flux L having a width B in the main scanning direction is imaged as the linear image S on the reflection surface 12 of the polygon mirror 4. Assume that S1 represents a width of the linear image S on the reflection surface 12 of the polygon mirror 4 in FIG. 5A, and S2 represents a width of the linear image S on the reflection surface 12 of the polygon mirror 4 in FIG. 5B.

In rotational phases of the polygon mirror 4 illustrated in FIGS. 5A and 5B, assuming that θ represents the laser incident angle, the linear image width S is expressed by the following equation (1), and the linear image width S1 according to the present exemplary embodiment can be narrowed by approximately 16% compared to the linear image width S2 according to the comparative example.

$$S=A/\sin(90-\theta/2) \quad (1)$$

The narrow width of the linear image S allows a large portion to be allocated to the rotational phase of the polygon mirror 4 within a range where the laser light flux L is prevented from hitting the corners 13*a* and 13*b* of the polygon mirror 4, thereby allowing the reflection surface 12 of the polygon mirror 4 to have a narrower width in the main scanning direction.

Figure 6A:
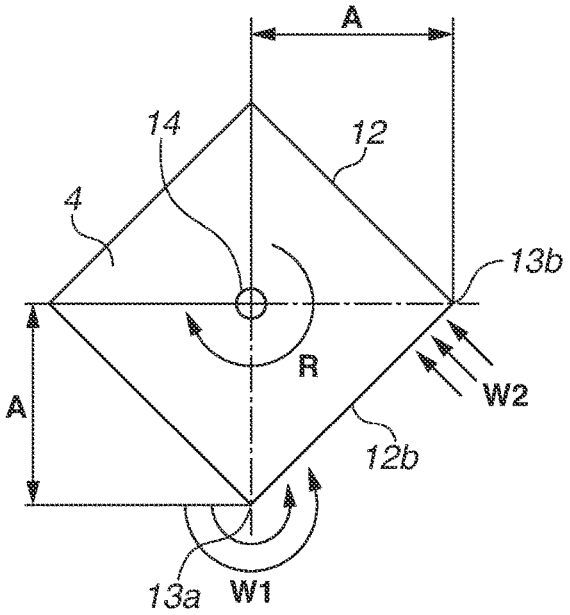
FIGS. 6A and 6B are schematic views illustrating an airflow around the reflection surface of the polygon mirror, and dirt on the reflection surface, respectively.
Figure 6B:
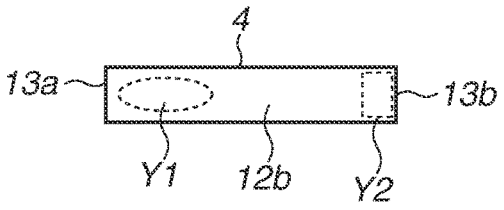

FIGS. 6A and 6B illustrate states of an airflow around the polygon mirror 4 when the polygon mirror 4 is rotated and dirt attached on the reflection surface 12, respectively. FIG. 6A illustrates the polygon mirror 4 as viewed from above the rotational shaft 14, and FIG. 6B illustrates the reflection surface 12*b* as viewed from a front side.

As illustrated in FIG. 6A, when the polygon mirror 4 is rotated in a direction indicated by an arrow R (the clockwise direction as viewed from above), an airflow occurs as indicated by W1 around the corner 13*a* of the reflection surface 12*b*. As a result, dust in the air is attached to a range labeled Y1 in FIG. 6B. Further, an airflow occurs as indicated by W2 in FIG. 6A around the corner 13*b* of the reflection surface 12*b*, and the dust is thrown against the reflection surface 12*b* and the dust in the air is attached to a range labeled Y2 in FIG. 6B.

The reduction in the width W of the reflection surface 12 of the polygon mirror 4 in the main scanning direction leads to a reduction in a distance A from a center of the rotational shaft 14 of the polygon mirror 4 to each of the corners 13*a* and 13*b* illustrated in FIG. 6A. The distance A and a speed of a uniform circular motion at each of the corners 13*a* and 13*b* are proportional to each other, so that the reduction in the width W of the reflection surface 12 in the main scanning direction leads to a reduction in the speed of the uniform circular motion at each of the corners 13*a* and 13*b*. As a result, a speed of each of the airflows indicated by W1 and W2 reduces, which makes it difficult for the reflection surface 12*b* to be contaminated.

Further, the airflow W1 is a turbulent flow and causes fluid noise, so that the reduction in the width W of the reflection surface 12 in the main scanning direction also leads to a reduction in the turbulent flow indicated by W1 and thus a reduction in the fluid noise. The reflection surface 12*b* has been described here, but the same also applies to the other three reflection surfaces.

Figure 7:
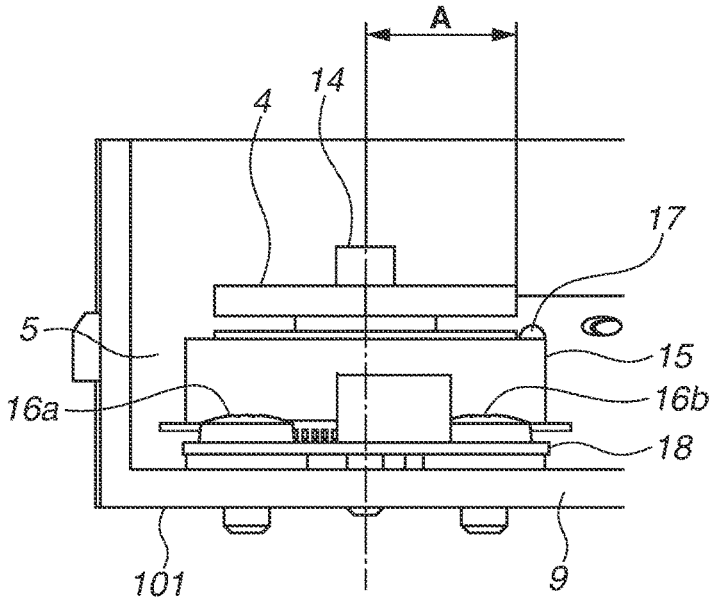
FIG. 7 is a schematic cross-sectional view of the optical scanning apparatus that illustrates a scanning motor.

Next, the scanning motor 5 in the optical scanning apparatus 101 will be described with reference to FIG. 7. FIG. 7 is a schematic cross-sectional view of the optical scanning apparatus 101.

In FIG. 7, the scanning motor 5 includes the rotational shaft 14, a rotor frame 15, a balance weight 17, and an iron substrate 18.

The scanning motor 5 is fixed to the optical box 19 via the iron substrate 18 with use of screws 16*a* and 16*b*. Further, the polygon mirror 4, the rotational shaft (a fixed shaft) 14, and the rotor frame 15 are rotationally driven as an integrated rotational body.

Now, a correction of balance of the rotational body will be described. The rotational body is subject to an offset of a center of gravity of the rotational body from a rotational center due to, for example, variations in a connected state of each of parts and a dimension of a part (initial unbalance). In other words, mass unbalance occurs in the rotational body, and dynamic disequilibrium occurs when the rotational body is rotationally driven. The occurrence of the dynamic disequilibrium may cause a vibration and/or noise due to a wobbling rotation of the rotational body, thereby resulting in deterioration of an image quality of the image forming apparatus D1 and/or an increase in the noise. Therefore, the present exemplary embodiment attempts to adjust the balance and reduce the mass unbalance of the rotational body by applying the balance weight 17 on a top surface of the rotor frame 15 forming the rotational body.

The balance weight 17 is formed by mixing metallic particles, glass beads, or the like in a photo-curable adhesive such as an ultraviolet curable adhesive, and is placed at an appropriate position of the rotor frame 15 by an appropriate amount and cured to be attached to the rotor frame 15 by being irradiated with light such as ultraviolet light. Further, if the balance weight 17 has low specific gravity, this leads to an increase in an application amount thereof, thereby causing a variation in the application amount, a shift of the application position, and/or an increase in a time period taken to cure the balance weight 17. If the balance weight 17 has high specific gravity, this leads to an increase in the variation in the application amount per application. Therefore, generally, a balance weight having specific gravity of approximately 1 to 3 is used.

The number of times that the balance is corrected depends on an initial unbalance amount of the rotational body. If the initial unbalance amount is large, the balance weight 17 should be applied by a large amount, which causes the variation in the application amount and/or the shift of the application position. Therefore, the balance may be unable to be corrected to a predetermined or smaller unbalance amount by being corrected once, and the balance may be corrected twice.

The initial unbalance amount of the rotational body can be expressed as a product of the mass of the rotational body and a distance from the rotational center of the rotational body to the center of gravity of the rotational body. Reducing the width W of the reflection surface 12 of the polygon mirror 4 in the main scanning direction leads to a reduction in the mass of the polygon mirror 4 and thus a reduction in the initial unbalance amount of the rotational body. As a result, the present exemplary embodiment can reduce the application amount of the balance weight 17 when the balance is corrected, thereby improving accuracy of the application amount of the balance weight 17. In other words, the present exemplary embodiment allows the balance to be accurately corrected, thereby allowing the balance weight 17 to be placed at one portion in the same correction surface. Therefore, the present exemplary embodiment can reduce the fluid noise of an unpleasant frequency that occurs at the balance weight portion due to the rotation of the rotational body. Further, the present exemplary embodiment reduces a weight of the rotational body by reducing the mass of the polygon mirror 4, thereby reducing an inertial moment of the rotational body and thus succeeding in shortening a time period taken until the rotational body reaches a rated number of rotations (a rise time period). In other words, the present exemplary embodiment can shorten a time period taken since the optical scanning apparatus 101 rises until the optical scanning apparatus 101 becomes ready for the exposure, thus shortening a time period taken for the image forming apparatus D1 to print the first page.

Next, how a shift of an irradiation position is improved when the size of the reflection surface 12 of the polygon mirror 4 in the main scanning direction is reduced will be described with reference to FIGS. 8A and 8B.

Figure 8A:
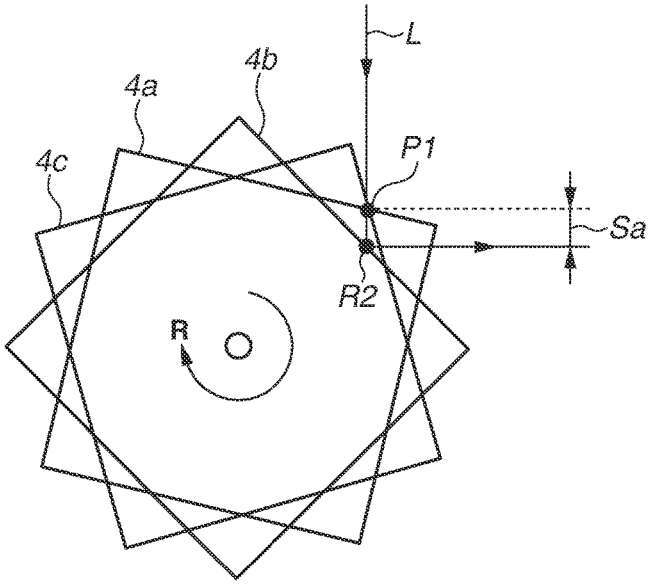
FIGS. 8A and 8B are schematic views illustrating a relationship between a positional shift of a deflection point on the polygon mirror and a positional shift of an exposure point in a sub scanning direction.

FIG. 8A illustrates the polygon mirror 4 as viewed from above the rotational shaft 14, and is a schematic view illustrating a shift of a point (a deflection point) where the laser light flux L is deflected on the reflection surface 12 of the polygon mirror 4. The polygon mirror 4 is rotated in the direction indicated by the arrow R around the rotational shaft 14. In FIG. 8A, 4*a*, 4*b*, and 4*c* represent three phase states of the polygon mirror 4 during the rotation in sequential order. The deflection point is P1 when the phase of the polygon mirror 4 is 4*a*, and is moved to P2 when the phase of the polygon mirror 4 is 4*b*. Then, the deflection point returns to P1 when the phase of the polygon mirror 4 is 4*c*. Assume that Sa represents a positional shift amount of the deflection point at this time. In FIG. 8A, the width B of the laser light flux L in the main scanning direction is omitted to make the description easily understandable.

Figure 8B:
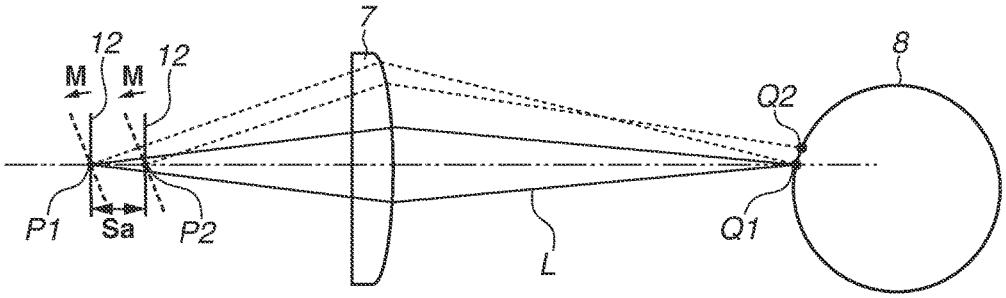

FIG. 8B is a schematic cross-sectional view of the optical scanning apparatus 101 in cross section that passes through the reflection surface 12, the scanning lens 7, and the photosensitive drum 8 and is taken along the direction (the sub scanning direction) perpendicular to the main scanning direction. In the sub scanning direction of the laser light flux L, the image is formed on the deflection point P1 on the reflection surface 12 of the polygon mirror 4, and the deflection point P1 and an exposure point Q1 on the photosensitive drum 8 are in a conjugate relationship with each other. Since the deflection point P1 and the exposure point Q1 are in the conjugate relationship with each other, a position of the exposure point Q1 is not shifted even when the reflection surface 12 is tilted as indicated by an arrow M. However, when a position of the deflection point is shifted from the deflection point P1 to the deflection point P2 according to the phase of the polygon mirror 4 as described with reference to FIG. 8A, the exposure point is also shifted to a position Q2 when the reflection surface 12 is tilted, because the conjugate relationship is lost at a position of the deflection point P2. The exposure point is periodically changed in the sub scanning direction due to a relative difference in the tilt of each of the reflection surfaces of the polygon mirror 4 (an optical face tilt). This is called pitch unevenness, and density unevenness (banding) occurs in the sub scanning direction due to the pitch unevenness.

Reducing the width W of the reflection surface 12 of the polygon mirror 4 in the main scanning direction leads to a reduction in the positional shift amount Sa of the deflection point when the polygon mirror 4 is rotated. The reduction in the positional shift amount Sa leads to a reduction in a shift amount of the exposure point in the sub scanning direction due to the optical face tilt, thereby improving the above-described banding.

In the present exemplary embodiment, the laser light flux L tilted upward is emitted from the semiconductor laser unit 1 toward the polygon mirror 4, and the BD sensor 6 is disposed above the semiconductor laser unit 1. This layout can reduce the laser incident angle, and reduce the width W of the reflection surface 12 of the polygon mirror 4 in the main scanning direction.

According to the present exemplary embodiment, processing cost and material cost of the polygon mirror are reduced due to the reduction in the width of the reflection surface of the polygon mirror in the main scanning direction. Further, the present exemplary embodiment makes it difficult to contaminate the end of the reflection surface because of the reduction in the rotational speed at the end of the reflection surface of the polygon mirror. Further, the present exemplary embodiment reduces the noise when the polygon mirror is rotated at a high speed. Further, the present exemplary embodiment shortens the time period taken until the polygon mirror reaches the rated number of rotations, thereby allowing the first page to be printed in a shorter time period. Lastly, the reduction in the size of the reflection surface of the polygon mirror leads to the reduction in the positional shift of the deflection point when the laser light flux is caused to scan on the photosensitive surface drum, thereby improving the banding.

In the above-described exemplary embodiment, the optical scanning apparatus 101 has been described referring to the configuration in which the BD sensor 6 is disposed above the semiconductor laser unit 1 in the direction along the rotational shaft 14 of the polygon mirror 4 by way of example, but is not limited thereto. The optical scanning apparatus 101 may be configured in such a manner that the BD sensor 6 is disposed below the semiconductor laser unit 1 in the direction along the rotational shaft 14 of the polygon mirror 4. More specifically, the optical scanning apparatus 101 may be configured in such a manner that the BD sensor 6 is disposed so as to allow the above-described incident point 6*a* to be located at a lower position than the emission point 1*a* of the semiconductor laser unit 1. In other words, the semiconductor laser unit 1 emits the laser light flux L tilted downward by the predetermined angle a degrees with respect to the horizontal direction toward the reflection surface 12 of the polygon mirror 4. The BD sensor 6 is disposed below the semiconductor laser unit 1, and the laser light flux L reflected by the polygon mirror 4 and tilted downward by the above-described predetermined angle $\alpha$ degrees with respect to the horizontal direction is incident on the BD sensor 6. A similar effect to the above-described exemplary embodiment can also be acquired by employing such a configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-047260, filed Mar. 13, 2017, No. 2017-248612, filed Dec. 26, 2017, which are hereby incorporated by reference herein in their entirety.

What is claimed is:

1. An optical scanning apparatus comprising:

a light source configured to emit a laser light flux;

a deflection unit configured to deflect the laser light flux emitted from the light source; and a light reception member configured in such a manner that the laser light flux reflected by the deflection unit is incident thereon, wherein the light source emits the laser light flux tilted by a predetermined angle with respect to a horizontal direction toward the deflection unit, and wherein the light reception member is disposed above or below the light source, and the laser light flux reflected by the deflection unit and tilted by the predetermined angle with respect to the horizontal direction is incident on the light reception member.

2. The optical scanning apparatus according to claim 1, wherein the light source and the light reception member are mounted on a same substrate.

3. The optical scanning apparatus according to claim 2, wherein the light reception member is mounted on the other surface opposite from one surface of the substrate where the light source is mounted.

4. The optical scanning apparatus according to claim 1, wherein the light source and the light reception member are arranged on a same line in a sub scanning direction perpendicular to a main scanning direction in which the laser light flux deflected by the deflection unit is caused to scan a scanning target surface.

5. The optical scanning apparatus according to claim 1, wherein the light reception member outputs a signal based on receiving the laser light flux, and the light source emits the light based on a timing when the signal is output.

6. The optical scanning apparatus according to claim 1, wherein the predetermined angle falls within a range of 2 to 10 degrees.

7. The optical scanning apparatus according to claim 1, wherein a distance between the light reception member and the light source is set within a range of 6 mm to 20 mm.

8. The optical scanning apparatus according to claim 1, wherein the light reception member is disposed in such a manner that an incident point on which the laser light flux is incident is located at a higher position or a lower position than an emission point of the light source from which the laser light flux is emitted.

9. An image forming apparatus comprising:

the optical scanning apparatus according to claim 1, wherein the image forming apparatus scans an image bearing member by the optical scanning apparatus, and forms an image on a recording material based on an image drawn from this scanning.

10. An optical scanning apparatus comprising:

a light source configured to emit a laser light flux;

a deflection unit configured to deflect the laser light flux emitted from the light source; and a light reception member configured in such a manner that the laser light flux reflected by the deflection unit is incident thereon, wherein the light reception member is disposed above or below the light source in a direction along a rotational shaft of the deflection unit, and the laser light flux reflected by the deflection unit and tilted by a predetermined angle with respect to a horizontal direction is incident on the light reception member.

11. The optical scanning apparatus according to claim 10, wherein the predetermined angle falls within a range of 2 to 10 degrees.

12. The optical scanning apparatus according to claim 10, wherein a distance between the light reception member and the light source is set within a range of 6 mm to 20 mm.

13. An image forming apparatus comprising:

the optical scanning apparatus according to claim 10, wherein the image forming apparatus scans an image bearing member by the optical scanning apparatus, and forms an image on a recording material based on an image drawn from this scanning.

14. An optical scanning apparatus comprising:

a light source configured to emit a laser light flux;

a deflection unit configured to deflect the laser light flux emitted from the light source;

a light reception member configured in such a manner that the laser light flux reflected by the deflection unit is incident thereon; and a substrate including a driving circuit configured to drive the light source, the substrate being provided with the light source and the light reception member mounted thereon, wherein the light reception member is disposed above or below the light source in a direction along a rotational shaft of the deflection unit.

15. The optical scanning apparatus according to claim 14, wherein a predetermined angle falls within a range of 2 to 10 degrees.

16. The optical scanning apparatus according to claim 14, wherein a distance between the light reception member and the light source is set within a range of 6 mm to 20 mm.

17. An image forming apparatus comprising:

the optical scanning apparatus according to claim 14, wherein the image forming apparatus scans an image bearing member by the optical scanning apparatus, and forms an image on a recording material based on an image drawn from this scanning.

18. An optical scanning apparatus comprising:

a light source configured to emit a laser light flux;

a deflection unit configured to deflect the laser light flux emitted from the light source; and a light reception member configured in such a manner that the laser light flux reflected by the deflection unit is incident thereon, wherein the light reception member is disposed above or below the light source in a direction along a rotational shaft of the deflection unit, and the laser light flux tilted by a predetermined angle is incident on the light reception member.

19. The optical scanning apparatus according to claim 18, wherein the predetermined angle falls within a range of 2 to 10 degrees.

20. The optical scanning apparatus according to claim 18, wherein a distance between the light reception member and the light source is set within a range of 6 mm to 20 mm.

* * * * *